US009004372B1

(12) United States Patent
Alsop et al.

(10) Patent No.: US 9,004,372 B1
(45) Date of Patent: Apr. 14, 2015

(54) DUAL HARDNESS BONDED DIRECT FIXATION FASTENER

(75) Inventors: Robert Alsop, Tucker, GA (US); Korhan Ciloglu, Pittsburgh, PA (US); Hakan Eksi, Dacula, GA (US); Michael O'Connell, Atlanta, GA (US)

(73) Assignee: L. B. Foster Company, Pittsburgh, PA (US)

( * ) Notice: Subject to any disclaimer, the term of this patent is extended or adjusted under 35 U.S.C. 154(b) by 29 days.

(21) Appl. No.: 13/597,477

(22) Filed: Aug. 29, 2012

Related U.S. Application Data

(60) Provisional application No. 61/528,577, filed on Aug. 29, 2011.

(51) Int. Cl.

| | |
|---|---|
| ***E01B 9/62*** | (2006.01) |
| ***E01B 9/48*** | (2006.01) |
| ***E01B 9/46*** | (2006.01) |
| ***E01B 9/38*** | (2006.01) |

(52) U.S. Cl.
CPC .... *E01B 9/46* (2013.01); *E01B 9/38* (2013.01)

(58) Field of Classification Search
CPC ..... E01B 9/68; E01B 9/681; E01B 9/685; E01B 9/688; E01B 9/62; E01B 9/683
USPC ..... 238/382, 283, 364, 287, 307
See application file for complete search history.

(56) References Cited

U.S. PATENT DOCUMENTS 6,027,034 A * 2/2000 Demmig et al. ..... 238/382

* cited by examiner

*Primary Examiner* — Mark Le
(74) *Attorney, Agent, or Firm* — Paul D. Banger, Jr.; Clark Hill PLC

(57) ABSTRACT

A bonded, direct fixation fastener as supportive structure for a rail on a railroad tie or bed comprising: a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having a rail securing device; a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane; a horizontal elastomeric portion of relatively lower durometer hardness encapsulating at least a portion of the bed plate and at least a portion of the rail plate; and vertical elastomeric portions of relatively higher durometer hardness encapsulating at least a portion of each bed plate tongue and at least a portion of each rail plate tongue, and surrounding the upper face of the rail plate; and wherein each vertical elastomeric portion is physically continuous with the horizontal elastomeric portion.

15 Claims, 3 Drawing Sheets

DUAL HARDNESS BONDED DIRECT FIXATION FASTENER

CROSS REFERENCE TO RELATED APPLICATIONS

This application claims the benefit of provisional patent application U.S. Ser. No. 61/528,577 filed Aug. 29, 2011, by the present inventors entitled Dual Durometer Direct Fixation Fastener which is incorporated by reference herein for all purposes.

FIELD OF THE INVENTION

This invention is related to a direct fixation fastener for attaching a rail to a railroad bed.

BACKGROUND OF THE INVENTION

Direct fixation fasteners are mainly used in transit railroad tracks to connect railroad rails to the underlying structure. These fasteners serve to three main purposes: (1) maintain integrity of track and gauge during operations; (2) reduce noise and vibration caused by train wheels; and (3) create electrical insulation between the rails and the ground. There are two main design approaches to achieve the desired properties: (1) two steel components bonded to each other by layer a rubber element in between (a.k.a. bonded direct fixation fastener) with both steel parts are also largely encapsulated in rubber during the manufacturing process; and (2) multiple elements assembled together without the incorporation the bonding process (a.k.a. non-bonded direct fixation fastener).

Bonded direct fixation fasteners (BDFFs) have been used by transit agencies in the United States for many decades. The BDFF design provides a one component solution for the unique needs of the transit railroad systems. Dynamic stiffness of the BDFFs dictates the noise and vibration mitigation performance of the BDFFs. While achieving the desired amount of noise and vibration mitigation, BDFFs must also withstand cyclic wheel loads in diverse environmental conditions for many years. Historically, BDFFs have been made using one grade of rubber and the vertical and lateral stiffness characteristics of BDFFs have been governed by a combination of the geometric details of the design and the properties of the rubber used in the BDFF.

BDFFs with low vertical stiffness are commonly sought to create softer cushions under the rails to provide higher noise and vibration reduction. When the geometrical constraints are set by the end user or track conditions, designers are usually left with softening the rubber element to achieve better noise and vibration reduction. When BDFFs are made softer in the vertical direction, they become softer in the lateral direction as well, which undesirably leads to premature failures under repeated cyclic loading and also to higher lateral deflection of the rail head.

SUMMARY OF THE INVENTION

In a preferred embodiment, the present invention comprises a dual durometer, bonded direct fixation fastener for securing a rail onto a railroad bed utilizes a relatively soft elastomer between a rail plate and a bed plate. The soft elastomer will move in a vertical direction by action of the weight of a train. To prevent movement in the horizontal direction, the two plates have upturned outside edges, and the upturned edges are encased in a relatively hard elastomers. The two elastomers are bonded to the two plates, and the two rubbers are physically continuous. The soft elastomer achieves a desired amount of noise and vibration mitigation while the hard elastomer prevents lateral deflection and extends the useful life of the fastener.

Advantages are achieved by placing a first, relatively soft elastomeric component between a steel rail plate and a steel bed plate. The soft rubber will move in a vertical direction by action of the weight of a train. The rail will not lift from the rail plate due to Pandrol clips. To prevent unwanted movement in the horizontal direction, (a) the steel bed plate is securely fastened to the railroad bed preventing unwanted movement and abrasion on the railroad bed, (b) both the rail plate and the bed plate have upturned outside edges or tongues, and (c) the upturned edges of the two plates are encased in a second, relatively hard elastomeric component. The two elastomeric components are physically continuous and cooperate to encapsulate both the rail plate and the bed plate.

In a first preferred aspect, the present invention comprises a bonded, direct fixation fastener as supportive structure for a rail on a railroad tie or bed comprising: a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having attachment means to attach to the rail; a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane; a horizontal elastomeric portion of relatively lower hardness encapsulating at least a portion of the bed plate and at least a portion of the rail plate; and vertical elastomeric portions of relatively higher hardness encapsulating at least a portion of each bed plate tongue and at least a portion of each rail plate tongue, and surrounding the upper face of the rail plate; and wherein each vertical elastomeric portion is physically continuous with the horizontal elastomeric portion.

In still other preferred embodiments of the bonded, direct fixation fastener of the present invention, the horizontal elastomeric portion fills the gap entirely or virtually entirely between the bed plate and rail plate.

In further preferred embodiments of the bonded, direct fixation fastener of the present invention, the vertical elastomeric portions and the horizontal elastomeric portion possess different mechanical properties at different geometrical details of the bonded, direct fixation fastener.

In additional preferred embodiments of the bonded, direct fixation fastener of the present invention, the first angle equals the second angle.

In further preferred embodiments of the bonded, direct fixation fastener of the present invention, the first angle does not equal the second angle.

In yet additional preferred embodiments of the bonded, direct fixation fastener of the present invention, the bed plate and rail plate are cast steel.

In further preferred embodiments, the bonded, direct fixation fastener further comprises a rail plate attachment means comprising channels to receive rail fastening means.

In yet additional preferred embodiments of the bonded, direct fixation fastener of the present invention, the rail fastening means is a Pandrol clip.

In further preferred embodiments, the bonded, direct fixation fastener further comprises a bed plate attachment means for attaching to the railroad tie or bed comprising an aperture for receiving bed plate fastening means.

In yet additional preferred embodiments of the bonded, direct fixation fastener of the present invention, the bed plate fastening means is selected from the group consisting of a spring, clip, clamp, spike, bolt, and bolt clamp.

In further preferred embodiments of the bonded, direct fixation fastener of the present invention, each rail plate tongue has an interior face and an exterior face and a tongue plane midway between the interior face and the exterior face; the rail plate horizontal plane is located between the rail plate lower face and rail plate upper face; a third plane defined by a line intersecting the rail plate horizontal plane and extending below the rail plate horizontal plane wherein an angle between the rail plate horizontal plane and the line is less than or equal to about 45 degrees and wherein the third plane defines the boundary between the vertical elastomeric portions and the horizontal elastomeric portion.

In additional preferred embodiments of the bonded, direct fixation fastener of the present invention, the angle is not greater than 10 degrees.

In yet additional preferred embodiments of the bonded, direct fixation fastener of the present invention, the angle is 0 degrees.

In further preferred embodiments of the bonded, direct fixation fastener of the present invention, the horizontal elastomeric portion has a relative durometer at least 5 lower than the durometer of the vertical elastomeric portion.

In additional preferred embodiments of the bonded, direct fixation fastener of the present invention, the horizontal elastomeric portion has a relative durometer at least 10 lower than the durometer of the vertical elastomeric portion.

In further preferred embodiments of the bonded, direct fixation fastener of the present invention, the horizontal elastomeric portion has a relative durometer at least 20 lower than the durometer of the vertical elastomeric portion.

In additional preferred embodiments of the bonded, direct fixation fastener of the present invention, the elastomeric portions are composed of rubber.

In another preferred aspect, the present invention comprises a method for making a bonded, direct fixation fastener as a supportive structure for a rail on a railroad tie or bed comprising: placing in a mold a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane; encapsulating, at least in part, in the mold, the bed plate with an uncured horizontal elastomeric portion of relatively lower hardness; placing in the mold a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having attachment means to attach to the rail; wherein at least a portion of the lower face of the rail plate is disposed in the uncured horizontal elastomeric portion of relatively lower hardness; encapsulating, in the mold, at least a portion of each bed plate tongue and at least a portion of each rail plate tongue with an uncured vertical elastomeric portion of relatively higher hardness; wherein the upper face of the rail plate is also surrounded, at least in part, by the uncured vertical elastomeric portion of relatively higher hardness; and curing the horizontal elastomeric portion and the vertical elastomeric portion.

In additional preferred embodiments of the method for making a bonded, direct fixation fastener of the present invention, the vertical elastomeric portion is physically continuous with the horizontal elastomeric portion.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
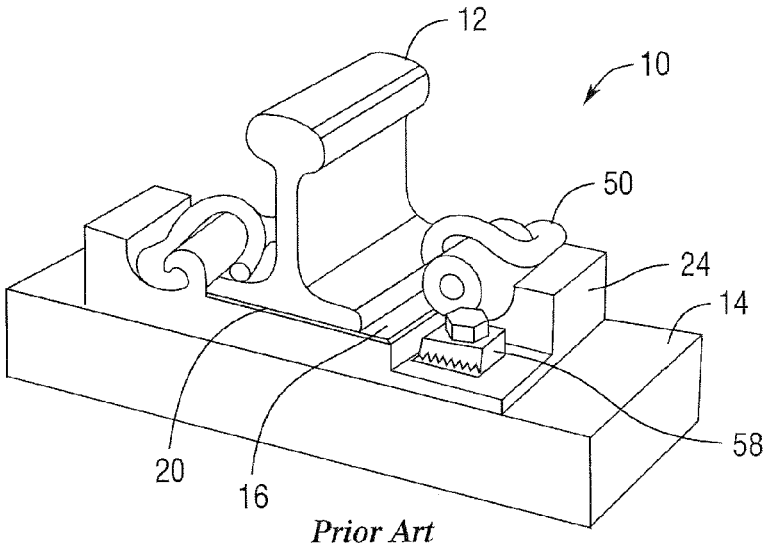
Prior Art Fig.1
FIG. 1 is drawing showing a typical bonded direct fixation fastener attached to a rail and mounted on a railbed.
Figure 2:
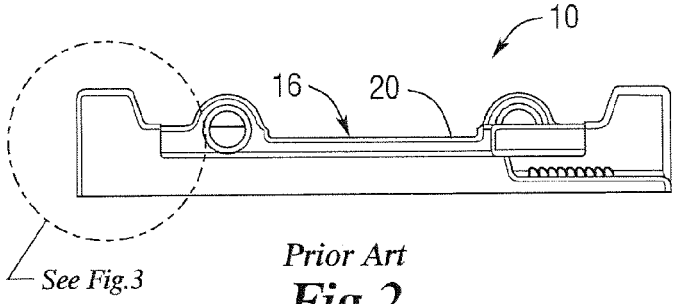
Prior Art Fig.2
FIG. 2 is a side perspective drawing of the side view of a bonded direct fixation fastener as known in the art.
Figure 3:
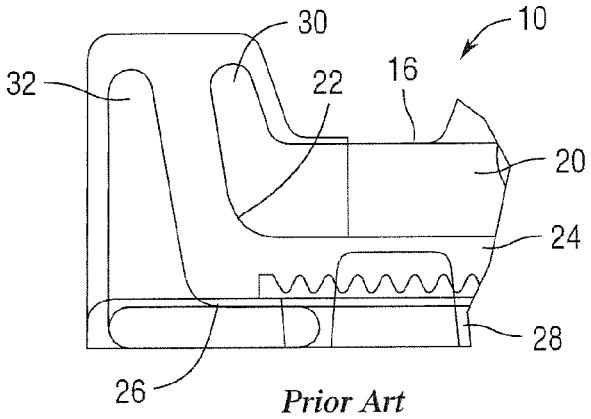
Prior Art Fig.3
FIG. 3 is a cross-sectional detail view of the direct fixation fastener of FIG. 2.
Figure 4:
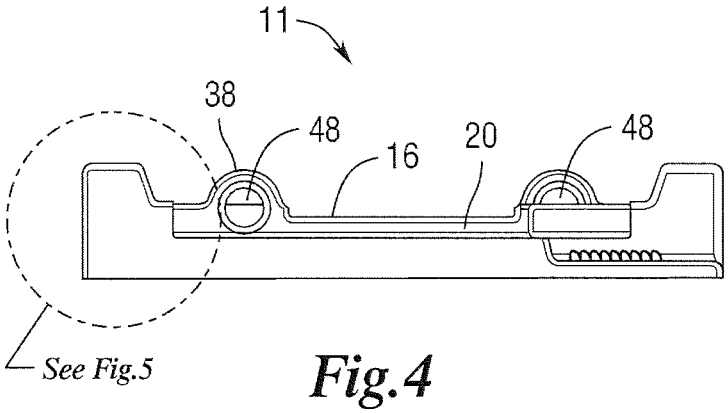
FIG. 4 a side perspective drawing of a preferred embodiment of a dual durometer bonded direct fixation fastener of the present invention.

FIGS. 1-3 illustrate the construction of a known BDFF 10 for attaching a rail 12 to a railroad bed, a railroad tie or other underlying structure 14. BDFFs of standard construction allow for noise and vibration reduction in addition to electrical isolation for protection against stray current flow. In the BDFF 10, vertical movement is controlled as the rail 12 is fastened to the upper face 16 of a rail plate 20. FIG. 2 illustrates the side view of the BDFF 10. The cross-section detail of section A is shown in FIG. 3, which illustrates the lower face 22 of the rail plate 20 bonded to or encapsulated by a uniform elastomeric layer 24, which in turn is bonded to or encapsulates the upper face 26 of a bed plate 28. Bed plate 28 is fastened to the railroad bed 14. Lateral movement of the rail plate 20 over the bed plate 28 is limited by the uniform elastomeric layer 24 encapsulating both the extending rail plate tongue 30 and the bed plate tongue 32 on opposing sides of the rail plate 20 and bed plate 28 as shown in FIG. 3.

However, if a uniform elastomeric layer 24 of relatively low durometer is used, the portion of the elastomeric layer 24 encapsulating the tongues 30, 32 wears rapidly. But, if a uniform elastomeric layer 24 of relatively high durometer is used, the portion between the rail plate lower face 22 and bed plate upper face 26 provides ineffective dampening.

Figure 5:
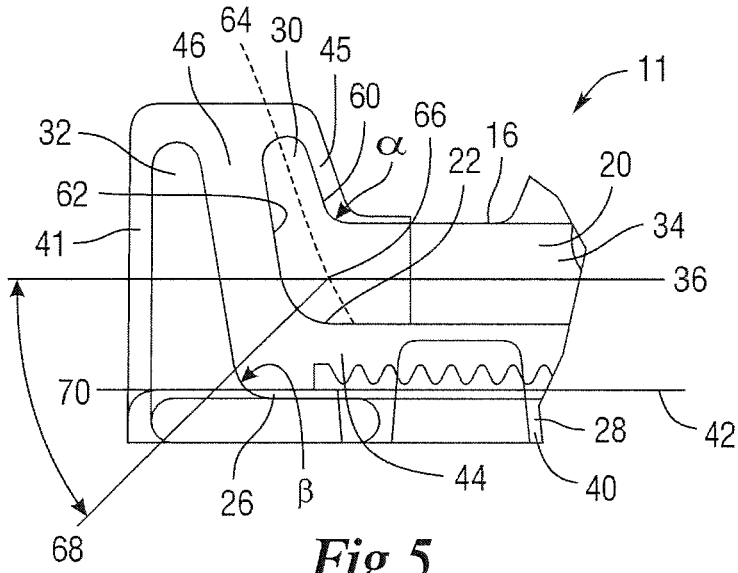
FIG. 5. is a cross-sectional detail view of the dual durometer bonded direct fixation fastener of FIG. 4.
Figure 6:
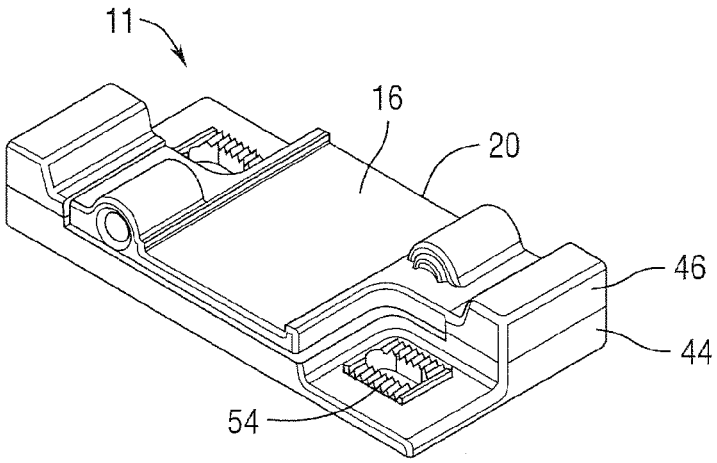
FIG. 6. is a perspective view of the dual durometer bonded direct fixation fastener of FIG. 4.
Figure 7:
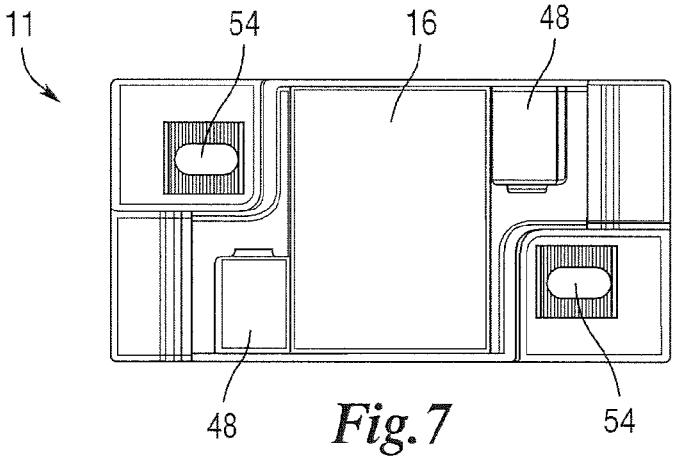
FIG. 7. is a top view of the dual durometer bonded direct fixation fastener of FIG. 4.
Figure 8:
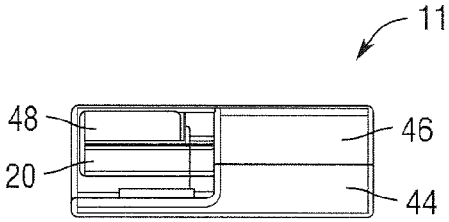
FIG. 8. is a side view of the dual durometer bonded direct fixation fastener of FIG. 4.

An illustrated preferred embodiment of the dual durometer BDFF 11 of the present invention is shown in FIGS. 4-8. FIG. 5 is a magnified cross-section of detail A of FIG. 4. The dual durometer BDFF 11 comprises a rail plate 20, wherein the rail plate 20 has a generally horizontal rectangular flat center portion 34 having a lower face 22 and an upper face 16. The rail plate 20 defines a rail plate horizontal plane 36 located between the lower face 22 and the upper face 16. From two opposing sides of the rail plate center portion 34 the rail plate 20 extends as rail plate tongues 30 disposed above the rail plate horizontal plane 36. The angle a between each respective tongue 30 and the upper surface 16 of rail plate center portion 34 may all be equal or different. The rail plate 20 has rail attachment means 38 to attach the rail plate 20 to the rail 12. The rail plate 20 may be made of any durable metal or alloy, and is preferably made of cast steel.

A preferred embodiment of the dual durometer BDFF 11 of the present invention further comprises bed plate 28, having a generally horizontal rectangular flat center portion 40. The bed plate 28 has an upper face 26 defining a bed plate horizontal plane 42. From two opposing sides the bed plate center portion 40 extends as bed plate tongues 32 disposed above the bed plate horizontal plane 42. The angle β between each respective tongue 32 and the upper face 26 of bed plate 28 may all be equal or different. Preferably, the bed plate 28 is dimensioned so that the rail plate 20 is loosely nestled near the bed plate 28 when configured in the dual durometer BDFF 11 of the present invention such that each rail plate tongue 30 is proximal to a bed plate tongue 32. The angles α and β may be equal to each other or different. The bed plate 28 is adapted to attach to the railroad bed 14. The bed plate 28 may be made of any durable metal or alloy, and is preferably made of cast steel.

Between the rail plate 20 and the bed plate 28 is a horizontal elastomeric portion 44 of relatively lower durometer hardness bonded to the bed plate upper face 26 and the rail plate lower face 22. In addition, vertical elastomeric portions 41, 45 and 46 of relatively higher durometer hardness encapsulate the bed plate tongue 32 and the proximal rail plate tongue 30 as shown in FIG. 5. Each of the vertical elastomeric portions 46 is physically continuous with the horizontal elastomeric portion 44.

The rail attachment means 38 may be any as used in the rail industry. In a preferred embodiment, at least one channel 48 is formed in the rail plate 20. Preferably, the rail plate 20 may be attached by means of the channel 48 by a clip 50. More preferably, the clip 50 may comprise a spring clip of a Pandrol design which is in standard use in the rail industry.

The bed plate 28 is preferably adapted to be attached to the rail bed 14. More preferably, the adaption is an aperture 54 in the bed plate 28. The bed plate 28 may be attached by any means used in the rail industry including spikes, screws, bolts, clips, spring clips, and bolt clamps 58.

Preferably, the relative angles of the tongues 30 and 32 are controlled. The rail plate tongue 30 extends from the side of the rail place center portion 34. The rail plate tongue 30 extends above the rail plate horizontal plane 36. The rail plate tongue 30 has a proximal interior face 60 and a distal exterior face 62. Midway between the rail plate tongue interior face 60 and the rail plate tongue exterior face 62 is a tongue plane 64. The angle 70 between the plane 68 and the rail plate horizontal plane 36 is preferably not greater than 45 degrees wherein the plane 68 represents the boundary between the relatively hard and soft elastomeric components in the dual durometer BDFF 11 of the present invention. Further, the horizontal elastomeric portion 44 of relatively lower durometer hardness is always disposed below the plane 68 while the vertical elastomeric portions 41, 45 and 46 are always disposed above the plane 68. More preferably, the angle 70 is not greater than 10 degrees below the rail plate horizontal plane 36. Most preferably, the angle 70 is 0 degrees.

Preferably, the dual durometer BDFF 11 of the present invention may be cast in a mold where a softer grade of elastomer or rubber would occupy the horizontal plane in the mold and a harder grade of elastomer or rubber would occupy the vertical planes in the mold. After vulcanization or curing of the elastomers in the mold, the dual durometer BDFF 11 of the present invention will be made softer in the vertical direction without compromising its stiffness and integrity in the lateral direction.

The horizontal elastomeric portion 44 is an elastomer of relatively lower durometer than the vertical elastomeric portion 46. Preferably, the relative difference in durometer is at least five. More preferably, the relative difference in durometer is at least 10. Most preferably, the difference in durometer is at least 15. The elastomeric portions 44, 46 are preferably made of an elastomeric material. More preferably, the elastomeric material is a natural or synthetic rubber.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A bonded, direct fixation fastener as supportive structure for a rail on a railroad tie or bed comprising:

a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having a rail securing device;

a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane;

a horizontal elastomeric portion of relatively lower hardness encapsulating at least a portion of the bed plate and at least a portion of the rail plate; and vertical elastomeric portions of relatively higher hardness encapsulating at least a portion of each bed plate tongue and at least a portion of each rail plate tongue, and surrounding the upper face of the rail plate;

wherein each vertical elastomeric portion is physically continuous with the horizontal elastomeric portion;

wherein each rail plate tongue has an interior face and an exterior face and a tongue plane midway between the interior face and the exterior face;

the rail plate horizontal plane is located between the rail plate lower face and rail plate upper face;

a third plane defined by a line intersecting the rail plate horizontal plane and extending below the rail plate horizontal plane wherein an angle between the rail plate horizontal plane and the line is less than or equal to about 45 degrees;

wherein the third plane defines a boundary between the vertical elastomeric portions and the horizontal elastomeric portion; and wherein the horizontal elastomeric portion has a relative durometer at least 5 lower than the durometer of the vertical elastomeric portion.

2. The bonded, direct fixation fastener of claim 1 wherein the horizontal elastomeric portion fills the gap entirely or virtually entirely between the bed plate and rail plate.

3. The bonded, direct fixation fastener of claim 1 wherein the vertical elastomeric portions and the horizontal elastomeric portion possess different mechanical properties at different geometrical details of the bonded, direct fixation fastener.

4. The bonded, direct fixation fastener of claim 1 wherein the first angle equals the second angle.

5. The bonded, direct fixation fastener of claim 1 wherein the first angle does not equal the second angle.

6. The bonded, direct fixation fastener of claim 1 wherein the bed plate and rail plate are cast steel.

7. The bonded, direct fixation fastener of claim 1 further comprising a plurality of channels defined by the rail plate wherein each channel receives a rail fastener.

8. The bonded, direct fixation fastener of claim 7 wherein the rail fastener is a clip.

9. The bonded, direct fixation fastener of claim 1 further comprising a bed plate attachment for attaching to the railroad tie or bed comprising an aperture for receiving bed plate fastener.

10. The bonded, direct fixation fastener of claim 1 further including a bed plate fastener is selected from the group consisting of a spring, clip, clamp, spike, bolt, and bolt clamp.

11. The direct fixation fastener of claim 1 wherein the angle is not greater than 10 degrees.

12. The direct fixation fastener of claim 1 wherein the angle is 0 degrees.

13. The direct fixation fastener of claim 1 wherein the elastomeric portions are composed of rubber.

14. A bonded, direct fixation fastener as supportive structure for a rail on a railroad tie or bed comprising:

a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having a rail securing device;

a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane;

a horizontal elastomeric portion of relatively lower hardness encapsulating at least a portion of the bed plate and at least a portion of the rail plate; and vertical elastomeric portions of relatively higher hardness encapsulating at least a portion of each bed plate tongue and at least a portion of each rail plate tongue, and surrounding the upper face of the rail plate;

wherein each vertical elastomeric portion is physically continuous with the horizontal elastomeric portion;

wherein each rail plate tongue has an interior face and an exterior face and a tongue plane midway between the interior face and the exterior face;

the rail plate horizontal plane is located between the rail plate lower face and rail plate upper face;

a third plane defined by a line intersecting the rail plate horizontal plane and extending below the rail plate horizontal plane wherein an angle between the rail plate horizontal plane and the line is less than or equal to about 45 degrees;

wherein the third plane defines a boundary between the vertical elastomeric portions and the horizontal elastomeric portion; and wherein the horizontal elastomeric portion has a relative durometer at least 10 lower than the durometer of the vertical elastomeric portion.

15. A bonded, direct fixation fastener as supportive structure for a rail on a railroad tie or bed comprising:

a rail plate, wherein the rail plate has a generally horizontal center portion having a lower face and an upper face and defining a rail plate horizontal plane, and wherein the rail plate center portion extends at a first angle from opposing sides as rail plate tongues above the rail plate horizontal plane, the rail plate having a rail securing device;

a bed plate comprising a generally horizontal center portion, an upper bed plate face defining a bed plate horizontal plane, and a pair of opposing bed plate tongues extending from opposing sides of the bed plate horizontal center portion disposed at a second angle above the bed plate horizontal plane;

a horizontal elastomeric portion of relatively lower hardness encapsulating at least a portion of the bed plate and at least a portion of the rail plate; and vertical elastomeric portions of relatively higher hardness encapsulating at least a portion of each bed plate tongue and at least a portion of each rail plate tongue, and surrounding the upper face of the rail plate;

wherein each vertical elastomeric portion is physically continuous with the horizontal elastomeric portion;

wherein each rail plate tongue has an interior face and an exterior face and a tongue plane midway between the interior face and the exterior face;

the rail plate horizontal plane is located between the rail plate lower face and rail plate upper face;

a third plane defined by a line intersecting the rail plate horizontal plane and extending below the rail plate horizontal plane wherein an angle between the rail plate horizontal plane and the line is less than or equal to about 45 degrees;

wherein the third plane defines a boundary between the vertical elastomeric portions and the horizontal elastomeric portion; and wherein the horizontal elastomeric portion has a relative durometer at least 20 lower than the durometer of the vertical elastomeric portion.

* * * * *